US005249396A

United States Patent [19]

Zuse

[11] Patent Number: 5,249,396

[45] Date of Patent: Oct. 5, 1993

[54] EXTENSIBLE AND CONTRACTIBLE MAST

[76] Inventor: Konrad Zuse, Im Haselgrund 21, D-6418 Hünfeld, Fed. Rep. of Germany

[21] Appl. No.: 724,975

[22] Filed: Jul. 2, 1991

[30] Foreign Application Priority Data

Aug. 2, 1990 [DE] Fed. Rep. of Germany ..... 4024574

[51] Int. Cl.[5] ..... E04H 12/18

[52] U.S. Cl. ..... 52/108; 52/118; 52/632

[58] Field of Search ..... 52/108, 117-118, 52/646, 115, 632

[56] References Cited

U.S. PATENT DOCUMENTS

| | | | |
|---|---|---|---|
| 3,361,377 | 1/1968 | Trexler, Jr. | 52 X/108 |
| 3,451,182 | 6/1969 | Lodrick . | |
| 3,474,976 | 10/1969 | Rushing et al. | 52 X/108 |
| 4,057,942 | 11/1977 | Kranefeld | 52 X/118 |
| 4,257,201 | 3/1981 | Landolt | 52/118 |
| 4,350,255 | 9/1982 | Blase et al. | 52 X/115 |
| 4,478,014 | 10/1984 | Poock | 52 X/118 |
| 4,918,896 | 4/1990 | Wiese | 52/632 |
| 4,961,370 | 10/1990 | Sawyer | 52 X/108 |
| 5,035,094 | 7/1991 | Legare | 52 X/632 |
| 5,062,245 | 11/1991 | Dent | 52 X/632 |

FOREIGN PATENT DOCUMENTS

| | | |
|---|---|---|
| 3804193 | 8/1989 | Fed. Rep. of Germany . |
| 4119466C2 | 5/1992 | Fed. Rep. of Germany . |
| 431917 | 9/1967 | Switzerland . |

*Primary Examiner*—Richard E. Chilcot, Jr.
*Assistant Examiner*—Beth A. Aubrey
*Attorney, Agent, or Firm*—Herbert Dubno

[57] ABSTRACT

A mast, column or post is assembled from successive segments which are arrayed along turns of a helix and are connected together successively and to the turns above and below such segments to enable a large diameter mast to be erected and, upon removal of the segments, to be lowered.

17 Claims, 4 Drawing Sheets

EXTENSIBLE AND CONTRACTIBLE MAST

SPECIFICATION

FIELD OF THE INVENTION

My present invention relates to an extensible and retractable mast which is comprised of a multiplicity of steel segments which can be withdrawn from at least one magazine, set into a helical turn and advanced with lifting of the resulting structure to form the mast which is terminated at its upper end by an upper terminal member and at its lower end by a lower or base terminal member.

BACKGROUND OF THE INVENTION

A mast which can be erected by withdrawing elements from a magazine and inserting these elements into a mast structure is disclosed in Swiss Patent 431,917.

The individual elements of this mast are tubular or rod-shaped and are formed at their opposite ends with complementary form-locking elements enabling successive elements to engage one another.

The extension of the mast is effected by inserting one element after another into previously positioned elements and, for this purpose, the mast comprises a lifting unit, an individual magazine containing the element and a device connected to that magazine for feeding the mast elements into the lifting unit. The lifting movement is effected by a lifting cylinder coaxial with the mast structure and located between the base of the mast. The mast is supported by roller bearings into which the elements are fed laterally The mast structure which thus results is limited in diameter and thus is limited in the loads which can be applied thereto.

It will be appreciated that the peak load which can be applied to the top of the mast, the resistance of the mast to bending in general and its static stability are all determined by the minimum diameter of the mast and thus by the minimum diameter of the mast elements making up the mast.

When cylindrical elements are used to assemble the mast and the mast is of large diameter, the individual elements become too heavy to handle with ease and too difficult to assemble in succession. As a consequence, a practical, high load capacity mast which can be assembled from successive elements utilizing these principles has not been realized heretofore.

OBJECTS OF THE INVENTION

It is, therefore, the principal object of the present invention to provide an extensible and contractible mast which can carry heavy loads and is not limited by dimensional considerations of the type described.

Another object of the invention is to provide a mast construction which can be of large diameter and can be erected from easily handled elements Still another object of the invention is to provide a mast system which allows the elements thereof to be easily stored and manipulated, and is characterized by an especially high static and dynamic ability even with loading.

A further object of the invention is to provide an extendable and contractible mast which is free from the drawbacks of the earlier system described

SUMMARY OF THE INVENTION

These objects and others which will become more readily apparent hereinafter are attained in accordance with an invention in a mast which is assembled from a plurality of helical shell segments fed to successive turns and interlocked with preceding shell segments and the shell segments of adjoining turns so that the segments surround a central space and a multiplicity of these segments define each turn of the helix. Since the rigid shell segments are structurally determinate elements and can be locked with successive shell segments to form the tubular mast structure, the entire structure can be fully determinate and can be composed of lightweight easily handled elements.

The mast structure is then assembled from a plurality of mast elements which are arranged one after the other along a helical-turn surface and which can consist of successive turns abutting one another along upper and lower edges of the mast elements in the form of individual components form-locking with one another. The mast includes a lifting device, at least one magazine containing a multiplicity of the mast elements, i.e. the rigid helical shell segments, and at least one device for feeding the mast elements into the lifting device, whereby the individual mast elements on the one hand interlock into a static and stable mast structure and, on the other hand, can be stored in and returned to a magazine Thus the shell segments can be withdrawn from the magazine and fed into the lifting device and, by attachment to the preceding shell segment, the mast structure can be raised to be terminated at its lower end by a base terminal element.

More particularly, the extensible and contractible mast of the invention can comprise a multiplicity of rigid helix shell segments adapted to be arrayed in succession along successive turns of a helix and provided with locking formations engagable with preceding and succeeding segments and with segments of overlying and underlying turns to form an extendable tubular mast structure;

at least one magazine containing a plurality of the segments;

a lifting unit for raising the mast structure; and means for removing the helix shell segments in succession from the magazine, supplying the shell segments to the lifting unit and inserting same in succession into a helical turn of the structure with elevation thereof, and for returning the shell segments to the magazine, whereby an initial shell segment forms an upper terminal member of the mast, subsequently added shell segments form the turns and a last-added shell segment forms a lower base terminal member of the mast.

The mast structure in the sense of the invention can include all elongated structures of practically any diameter which can extend vertically upwardly from the ground or a foundation and can include masts, towers, columns, posts, pillars or the like which can be raised and lowered, i.e. which can be erected or disassembled and which can be permanently emplaced if desired or only periodically or intermittently erected and which can have, if desired, a variable height.

The load can be the load of the column itself or a load applied above the upper terminal element. Typical of the loads which can be carried by the mass or columns of the invention are wind-driven electrical generators. Of course, a load can be applied to the mast before the upper terminal elements, as the mast is erected, or after the mast has been erected and the load will generally bear on the upper-most turn of the helix of the mast or column and can be connectable thereto.

The invention utilizes the principle that the mast can be a shell erected with a multiplicity of shell elements or mast elements (segments) per turn so that the successive turns approximate a cylindrical surface which can be of substantially greater diameter than previously provided masts, since the individual shell segments which are assembled to form the cylinder can be easily handled, mounted in a helical pattern and united to form the successive turns. This arrangement of the mast or column segments enables an at least quasi continuous insertion or removal of the segments and thus erection or disassembly of the mast or column.

U.S. Pat. No. 3,451,182 discloses a collapsible pole which does employ a helical pattern of turns which can telescopingly extended. The helical turns, however, form part of a single flexible member. To form a column or mast structure with this system, the element which is extended must have a length which is a multiple of the height of the desired column. Axial loadability of this system is limited and the diameter of the structure which can be fabricated is likewise limited.

With respect to the stability of the mast structure, it has been found to be advantageous to offset the upper and lower edges of the mast element in the longitudinal direction of the respective turn. According to a further feature of the invention, each three segments of the mast can be connected in a form-locking manner by appropriate formations and in neighboring turns in a shear-resistant manner so that these three interconnected segments of adjoining turns cannot shift relative to one another and the shear forces between them can be taken up or blocked by the formations interconnecting these elements or segments.

In the simplest construction, the individual turns are braced against one another only by their weight. For increased stability, however, it has been found to be advantageous to provide locking means between the successive turns and, indeed, to provide the releasable locking means so that each of the segments has a locking device which enables it to lock to a successively applied segment and a segment of an adjoining turn.

An especially effective tension-resisting connection can be provided with a locking device in which each segment comprises a pivotal lever having at least two shanks and swingable about a shank axis extending perpendicular to a respective mast element or helical shell segment. One shank of the lever can be formed with an elongated slot or notch engaging a pin of a substantially applied shell segment while the other shank of the lever is engagable into an undercut recess of a segment of an adjoining turn and can have a pin engagable over the undercut portion so that the lever is swung into position locking the first shell segment against the overlying shell segment as the pin of a successive shell segment engages in the slot or notch of the first shank. Upon separation of each shell segment from the mast structure, the withdrawal of its pin from the slot will allow the lever to pivot by its own weight out of engagement with the overlying shell segment, thereby enabling the successive shell segments to be removed.

In a preferred embodiment of the invention, the shell segments or mast elements have manipulating recesses or abutments cooperating with the support arms, manipulating arms and lifting arms and the lifting units and/or the manipulator for manipulating the shell segments out of the magazines. In a simple construction of the segment, the latter is formed with reinforced edges forming planar edges which can abut the surfaces of the segments of upper and lower turns. The formations providing the form-locking connection between successive turns can include cylindrical pins projecting from such edges into cylindrical sockets or bores receiving these pins.

It has been found to be advantageous, moreover, to provide the lifting unit within the wall formed by the mast structure, thereby forming an especially compact device.

In an especially advantageous embodiment of the invention, the lifting device comprises a stator coaxial with the tubular structure, i.e. having a common axis therewith and formed with radially outwardly extending and axially shiftable carriers. Each can be formed with at least one radially shiftable lifting arm. The stator cooperates with a rotor having common surfaces with which the carriers and lifting arm are in functional or operative engagement. The number of carriers is at least equal to the number of column elements or shell segments required to form a complete turn of the helix. The carriers are uniformly distributed around the periphery of the mast and the camming surfaces are so constructed that upon rotation of the rotor, in a periodic sequence, a mast segment is engaged by a lifting arm from a magazine located outside the perimeter of the structure and is radially moved inwardly and brought into flush registry with the previous segment, is lifted in a first phase into engagement with the preceding segment and is thereafter in a second phase, so moved as to complete the locking engagement of the segment in place.

The mast erection system as thus described can be provided with a automated drive for the erection of the mast and its retraction by, respectively, adding the segments in succession, or removing them in succession.

For extension of the mast, therefore, it is merely necessary to drive the rotor, for example, by an electronic motor, to eliminate the manual operations previously required for erection of the mast. The positioning of each successive mast segment can be effected without an additional drive, utilizing solely the weight of, for example, the locking or latching lever or other locking device. Of course, a brake can be provided for the movement of the structure and/or some other locking device can be utilized for positioning the segment to be latched in place. The lifting device can then operate continuously at a variable and selectable speed. Problematical transfer of the segments from the magazines to the tubular structure and positioning of a carrier in the vertical direction over the width of the helix at the end of each rotation of the rotor can be avoided when the number of carriers of the lifting device is twice that of the elements or segments of a turn and when each carrier forms a carrier pair associated with a cam surface pair on the rotor. The individual control surfaces of the pair of camming elements can be rotated relative to one another with respect to the axis of rotation and so that the engagement of a segment and the first phase on the one hand and the second lifting phase one the other hand can be effected by each carrier pair. In this case, the second lifting phase of the carrier of one of the carrier pairs can overlap at least partly the positioning of a new segment during rotation of the rotor, thereby positively positioning the newly introduced segment.

Advantageously, each carrier or carrier pair is associated with one magazine for the respective segments and a respective device for transferring the segments to the lifting unit.

An especially space-saving mounting of the additional mast elements has a magazine provided with at least one mounting arm upon which a plurality of mast segments can be arrayed vertically and disposed in a nested arrangement with an outwardly convex side and an inwardly concave side.

According to a further feature of the invention, the device for transferring the mast elements or segments to the lifting unit comprises two sets of manipulating arms which are radially and axially- shiftable relative to the mast structure axis, the rotor having camming surfaces which are in operative relationship or functional contact with the manipulating arm sets. The mast elements or segments by alternating axial and/or radial movement are successively moved from the segment magazines in the radial direction toward the lifting device and are transferred to the lifting device under the control of the lifting device camming surfaces. In this embodiment, a fully automatic raising and lowering of the mast can be ensured, the operation requiring only a corresponding control command by a service person or a control device.

The apparatus of the invention can comprise a windspeed-measuring in response to which the mast can be contracted when the windspeed exceeds a predetermined threshold value.

BRIEF DESCRIPTION OF THE DRAWING

The above objects, features and advantages of my invention will become more readily apparent from the following description, reference being made to the accompanying drawing in which.

SPECIFIC DESCRIPTION

Figure 1:
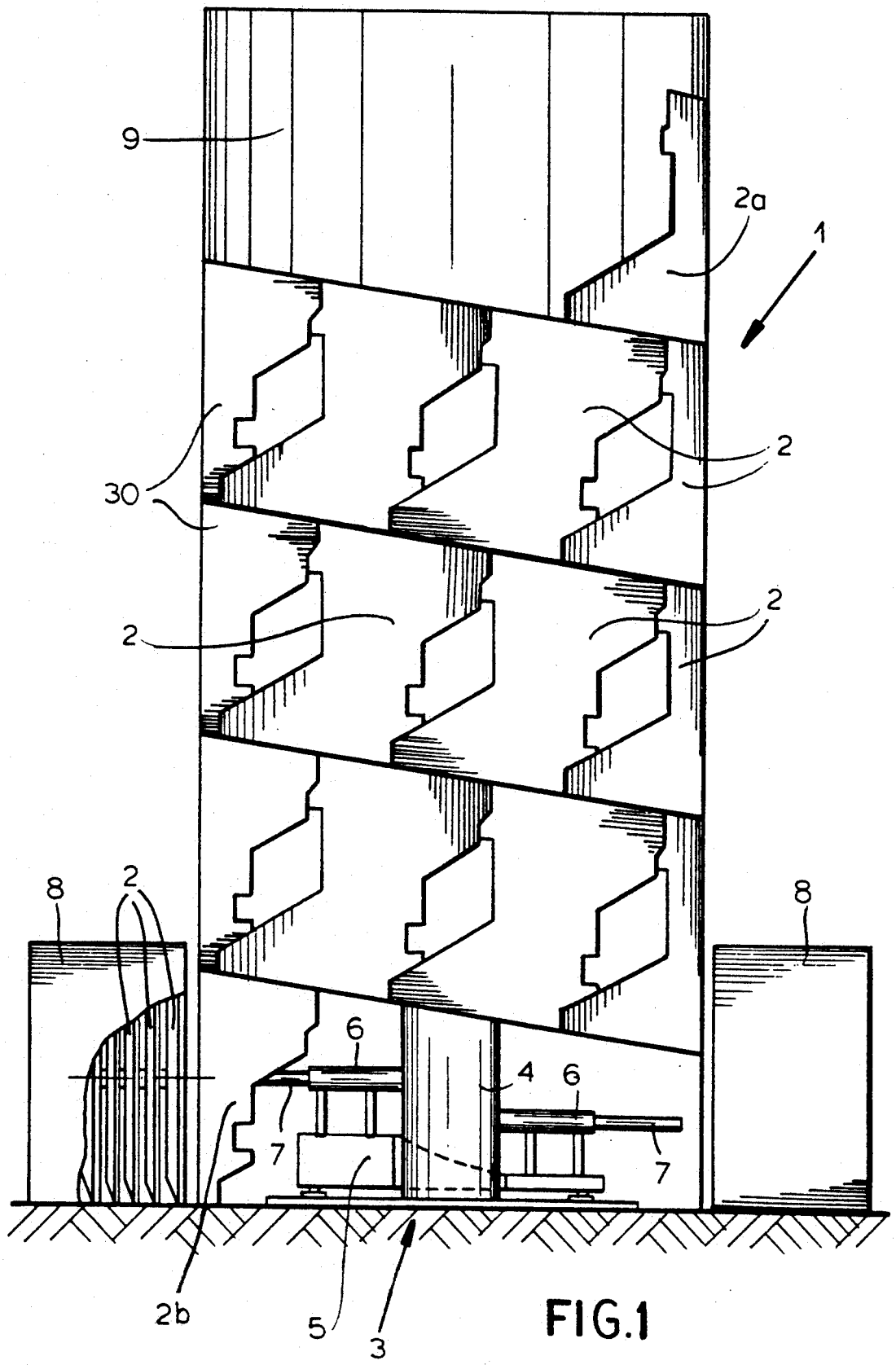
FIG. 1 is a side-elevational view of a mast segment according to the invention which can be extended upwardly or contracted downwardly.

FIG. 1 shows an extendable or contractible mast 1 which is formed from a multiplicity of mast elements or shell segments 2 arrayed one behind the other to form helical turns 30 of the mast. For simplification, the lateral segments 2 have not been illustrated in an inclined projection.

Figure 4:
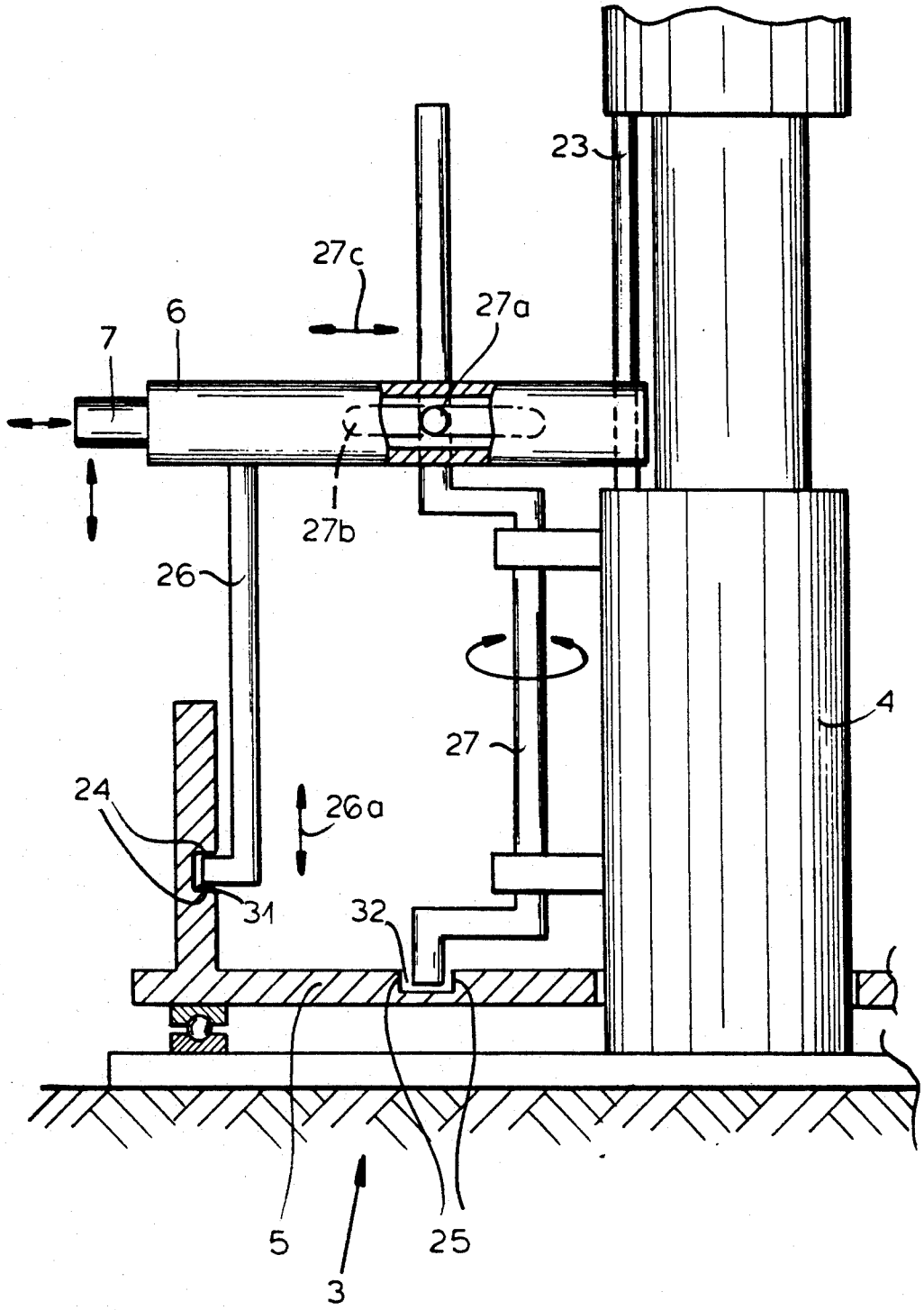
FIG. 4 is a partial elevational view of the lifting device of the invention.

In the interior of a tubular structure a lifting device or unit 3 is provided, this device having a stator 4 and a rotor 5 (see also FIG. 4).

Figure 2:
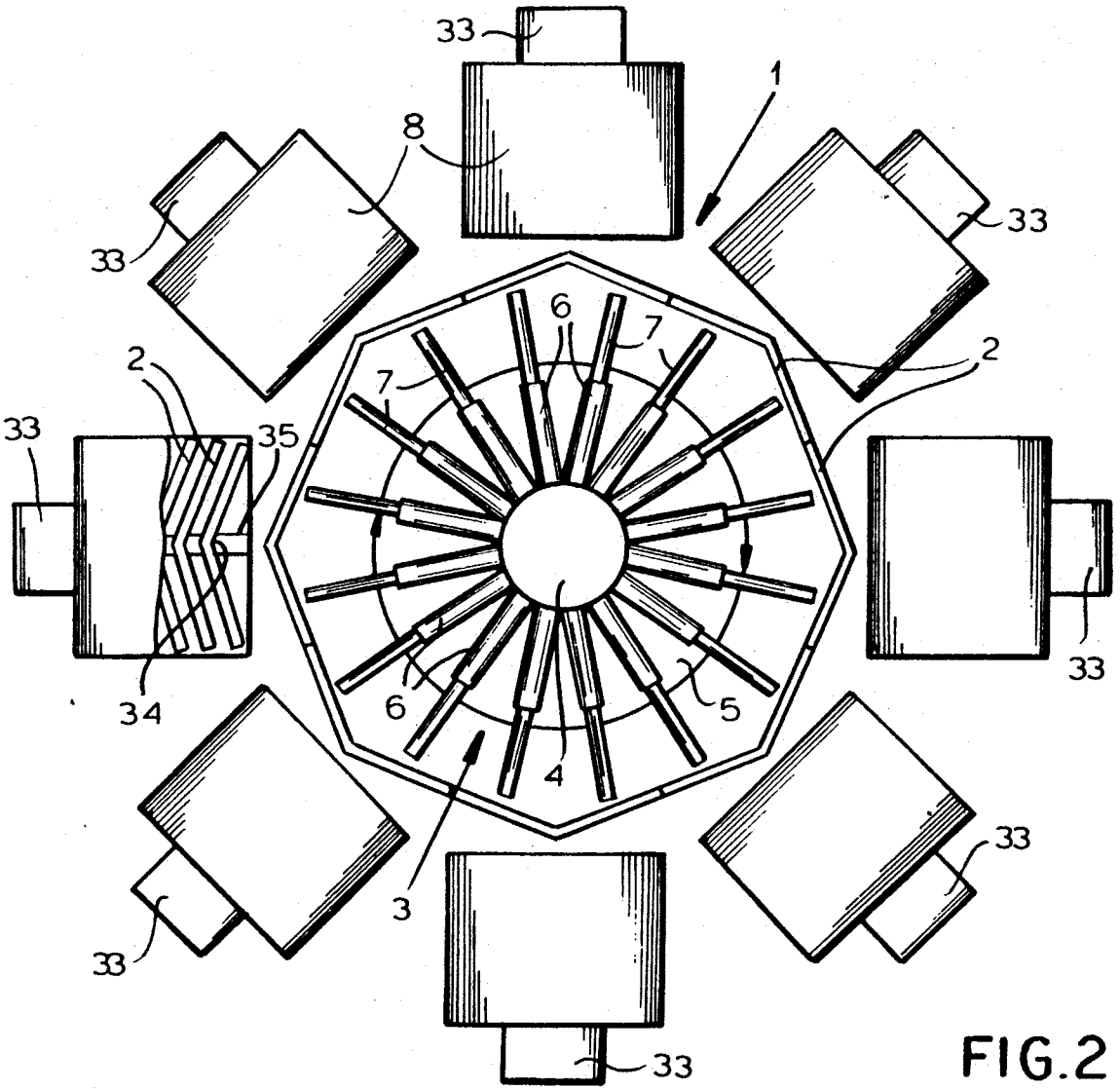
FIG. 2 is a diagrammatic plan view, partly broken away of the system of FIG. 1.

On the stator, two carriers 6 are provided for each segment of a complete turn of the helix and for each of the plurality of magazines 8 illustrated in FIG. 2 are provided so that the carriers 6 ar axially shiftable. The carriers 6 are positioned by camming surfaces 24 and 25 of the rotor 5.

Carriers 6 are formed with lifting arms 7 shiftable in the radial direction and, where possible, are also shiftable in the radial direction and whose position can also be determined by the rotor's camming surfaces 24 and 25. The camming surfaces 24 and 25 can be formed as the flanks of grooves 31 and 32 when the cams operating the unit 6, 7 are slave cams, as has been shown in FIG. 4.

From FIG. 1, it is possible also to observe that the magazines 8 for the respective segments are angularly equispaced about the axis of the mast structure 1. Each magazine can feed successive segments 2 to the helix.

In the magazines 8 devices for feeding the segments 2 to the lifting unit 3 are provided, these devices having not been illustrated in any detail, but being represented by the block 33 in FIG. 2.

For the extension or raising of the mast structure 1 a shell segment is first withdrawn from the segment magazine 1 by a respective feeding member and transferred to the lifting arms 7. The first segment to be supplied has been represented at 2*a* in FIG. 1 and is referred to as an upper terminal member. The last segment to be supplied is a base terminal element 2*b*. Upon the structure 1 and connected to the first complete turn is a load 9 to be lifted by the mast. The underside of the load 9 corresponds to the configuration of the first complete turn of the mast, i.e. is helical.

From FIG. 2 in which the raising and lowering system has been shown in greater detail, it will be apparent that each segment 2 is formed with a fold, crease or bend line 34 so that within each magazine a succession of the segments can be arrayed upon an arm 35 capable of transferring a segment to the lifting arms and under the control of the respective unit 33. The crease or bend in each segment is such that the segment is concave inwardly toward the axis of the mast and convex outwardly and the segments interfit with one another. The bends are such that the number of segments forming a full turn of the helix will define a regular polygon centered on the axis of the helix.

In a star-shaped array around the stator 4 a multiplicity of carriers are disposed and in such number that each two carriers 6 are associated with one mast element or segment 2 of the lower most turn of the helical structure. The pairwise arrangement of the carriers ensures a positive positioning of the lifting arms 7 and engagement of each segment 2 in two holes, openings or seats thereof. From FIG. 2 it will also be apparent that each pair of carriers 6 is juxtaposed with a respective segment magazine 8, the segment magazines being oriented in a star-shaped array.

Figure 3:
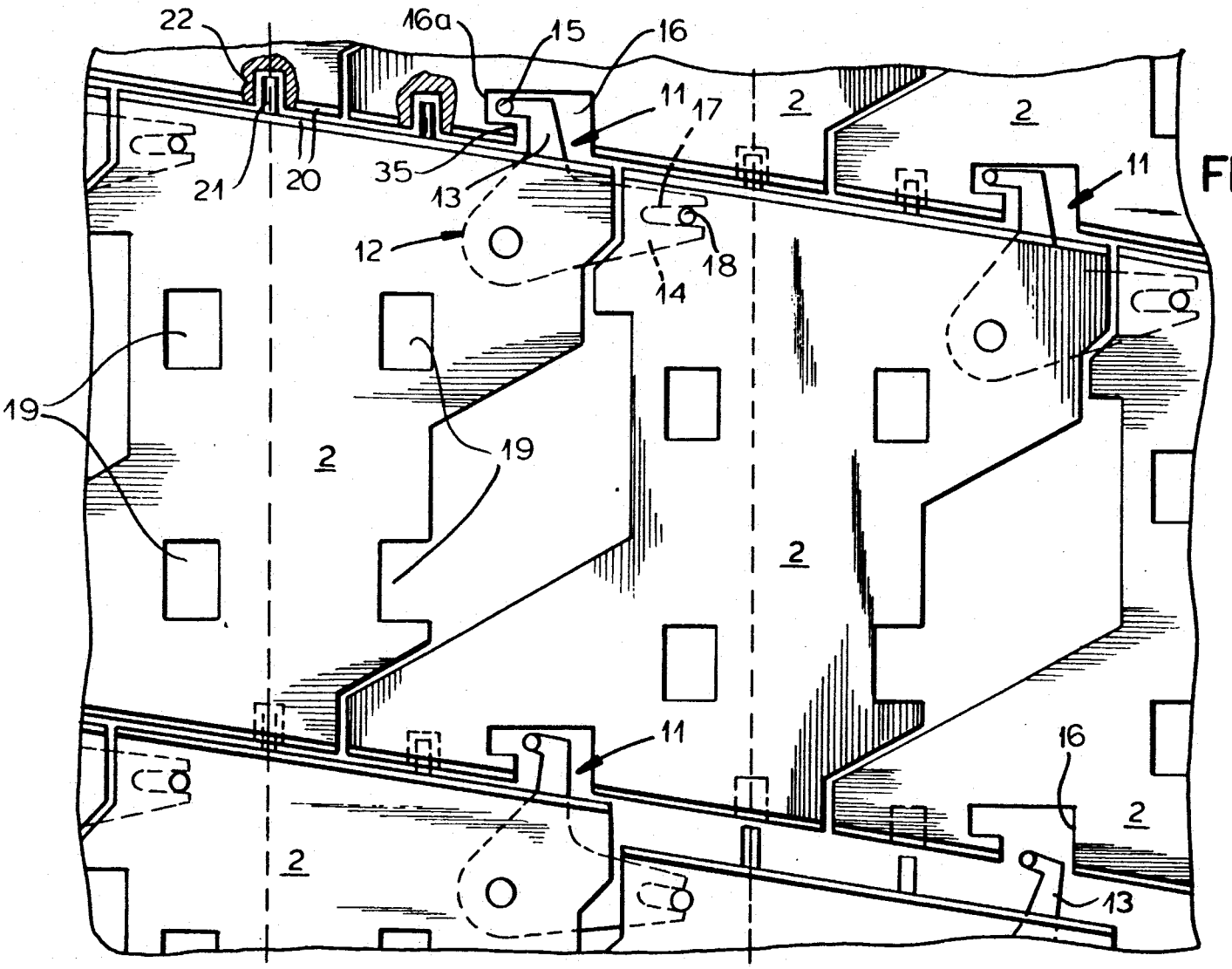
FIG. 3 is a detailed elevational view of the connection of the mast segments.

Turning now to FIG. 3, in which the segments are shown in detail and from which the configurations of each segment can be seen, it will be noted that the broken lines represent creases of the segments as described.

Each segment 2 is reinforced along its upper and lower edges which are offset from one another along the helix. Form-locking elements on the segments lock each three segments 2 of neighboring turns together in a helical pattern, so that the segments cannot suffer shear or sliding movement relative to one another. As a consequence of this configuration, especially high static stability of the segment connections can be achieved. This static stability is additionally raised by the presence of reliable locking devices 11 with which successive turns of the helical structure are joined two overlying and underlying turns in a manner resisting the application of tensile forces to the system. As indicated, each segment 2 has a respective locking device 11. The locking devices 11 comprise swingable levers 12 pivotally connected to each segment perpendicular to the surface thereof. Each lever 12 has two shanks or arms 13, 14. The shank 13 is formed at its end with an outwardly projecting pin 15 and which, upon pivoting of the lever 12 in the counterclockwise sense an engagement in a recess 16 in the lower edge of an overlying segment comes into operation. The recess 16 has an undercut 16*a* so that the pin 15 can overhand a ledge 35 of the overlying segment.

The other shank of the lever 12 is formed with a slot or notch 17 in which a pin 18 of a successive segment 2 can engage.

At the upper part of FIG. 3, one can see two latching elements 11 which have already been swung into the locking position. In the lower portion of FIG. 3, two latching elements 11 have been illustrated of which one is almost fully in position while the other is first entering the respective recess 16. As the successive elements are applied, therefore, they swing the latches into the engaged position and lock the assembly together. Conversely, upon successive withdrawal of the lowermost segments from the helical structure, latches are released to enable separation of the segments.

The segments 2 are provided with manipulating openings 19 engageable in mounting arms, manipulating arms and lifting arms as described previously. The upper and lower edges of the segments 2 are provided at 20 with reinforced edges having planar abutment surfaces against which the segments of adjoining turns can lie. On these edges, mating formations in the form of cylindrical pin 21 and cylindrical pins 22 are provided to permit one segment to interfit with a segment of an overlying turn.

FIG. 4 shows the lifting device 3 in a partial section. Coaxial with the helical structure and within the latter, I provide a stator 4 with guides 23 along which the carriers 6 are axially shiftable. The carriers 6 have radially outwardly displaceable lifting arms 7. To avoid confusion, in the illustration only a single carrier 6 of a single pair of such carriers has been illustrated in FIG. 4.

The lifting unit 3 also comprises a rotor 5 with camming surfaces 24, 25 for the axial displacement of the carrier and for the radial movement of the lifting arm. A cam follower a lever 27 can be connected by a pin 27*a* slidable in a groove 27*b* of the carrier 6 to control the displacement of the holder 7 (see arrow 27*c*). Similarly, a cam follower 26 is connected to the carrier 7 to effect the displacement thereof as represented by the arrow 26*a*. Consequently, the cam follower 26 provides the requisite information for the axial shifting for carrier 26 while member 27 provides the control information for the radial movement for the lifting arm 7. It will be understood that for the two carriers 6 of the carrier pair, respective camming surfaces 24 and 25 are provided to ensure that upon rotation of the rotor 6, always one carrier will hold a respective segment in position until an underlying turn is to be formed.

In the embodiment illustrated, moreover, the rotor 5 rotates about the axis of the helical structure while the stator 4, the helical structure 1 itself, the carriers 6 and the magazines 8 are stationary. In a kinematic reversal, of course, all of the these stationary elements can rotate while member 5 carrying the cam surfaces, can be stationary. In this case, the helical structure composed of the segments 2 can rotate as the segments are successively introduced from the respective magazines.

In operation, therefore, with the member 5 rotating, as each magazine contributes a segment it is inserted below a previous turn to raise the helix and allow the segment from the next magazine to be inserted. The process continues until the lower terminal member 2*b* is inserted. Reversal of the sense of rotation of member 5 can successively remove the segments to the lower mast.

I claim:

1. An extensible and contractible mast, comprising:

a multiplicity of rigid helix shell segments adapted to be arrayed in succession along successive turns of a helix and so that each of a multiplicity of segments has preceding and succeeding segments and is disposed between segments of overlying and underlying turns, said segments being provided with locking formations engageable with preceding and succeeding segments and with segments of overlying and underlying turns to form an extendable tubular mast structure, each of a plurality of turns of the helix being constituted from a multiplicity of said segments;

at least one magazine containing a plurality of said segments;

a lifting unit for raising said mast structure; and means for removing said helix shell segments in succession from said magazine, supplying said shell segments to said lifting unit and inserting said in succession into a helical turn of said structure with elevation thereof, and for returning said shell segments to said magazine to provide an initial shell segment, subsequently added shell segments and a last-added shell segment, whereby said initial shell segment forms an upper terminal member of said mast, said subsequently added shell segments form said turns and said last-added shell segment forms a lower base terminal member of said mast, each of said segments being formed unitarily with upper and lower edge formations bracible against segments thereabove and therebelow respectively and provided with form-locking means interengaging with the segments thereabove and therebelow.

2. The mast defined in claim 1 wherein each segment has upper and lower edges of each of said segments offset from one another along said turns.

3. The mast defined in claim 1 wherein said locking formations are constructed so that each three segments of neighboring turns are locked against shifting relative to one another.

4. The mast defined in claim 1, further comprising means for releasably locking each turn to an overlying turn and an underlying turn in a tension-resisting connection.

5. The mast defined in claim 4 wherein said means for releasably locking includes a locking element provided on each of said segments.

6. The mast defined in claim 5 wherein each of said locking elements comprises a lever pivotally connected to one of said segments and having at least two shanks, one of said shanks engaging a successive segment of the same turn and another of said shanks engaging a segment of another of said turns.

7. The mast defined in claim 6 wherein said one of said shanks is formed with a notch receiving a pin and the other of said shanks is formed with a pin engageable in a cutout formed in a respective segment so that upon engagement of a third of said segments with the segment provided with said lever, said other of said shanks engages in said recess to lock three segments together.

8. The mast defined in claim 7 wherein each of said segments is provided with openings engageable by arms of said means for removing said helical shell segments from said magazine.

9. The mast defined in claim 1 wherein each of said segments is formed with reinforcements unitary therewith for rigidifying the respective segment.

10. The mast defined in claim 9 wherein said reinforcements are reinforced edges of the respective segment formed with planar abutment surfaces.

11. The mast defined in claim 1 wherein said formations include cylindrical pins on one of said segments and cylindrical bores receiving said pins on others of said segments.

12. The mast defined in claim 1 wherein said lifting unit is located within a wall formed by said structure.

13. The mast defined in claim 1 wherein said lifting unit comprises a stator coaxial with said structure and formed with radially outwardly extending and axially shiftable carriers, each of said carriers being provided with a radially shiftable lifting arm engageable with a respective segment, and a rotor having camming surfaces for actuating said carriers and said arms, the number of said carriers being at least equal to the number of said segments required to form a full turn of said structure, said carriers being uniformly distributed about a periphery of said structure and said camming surfaces being configured such that upon rotation of said rotor, said arms in the periodic sequence in which said segments follow one another in said structure, are radially displaced to engage a segment, withdraw it from said magazine and engage said segment with said structure in a first lifting phase and to effect locking of the respective segment to said structure in a second lifting phase.

14. The mast defined in claim 12 wherein the number of said lifting units is double the number of said segments forming a complete turn of said structure, each two of said carriers is formed as a carrier pair displaced by a pair of cam surfaces on said rotor, said cam surfaces being offset relative to one another about an axis of rotation of said rotor so that the first and second phases are effected alternatively by a carrier pair.

15. The mast defined in claim 14 wherein each of said carrier pairs is associated with a respective magazine containing a plurality of said segments and a respective device for supplying said segments to said lifting unit.

16. The mast defined in claim 1 wherein said magazine is provided with at least one storage arm upon which a multiplicity of said segments are mounted vertically interfitted with one another and with outwardly turned convex sides and inwardly turned concave sides.

17. The mast defined in claim 1 wherein said means for removing said helix shell segments in succession from said magazine include two manipulating arm sets which are shiftable radially and axially with respect to an axis of said structure, said unit comprising a rotor having camming surfaces for actuating said manipulating arm sets and radially moving said segments into alignment with said structure and axially displacing said segments in alignment with said structure.

* * * * *